US006695073B2

(12) United States Patent
Glass et al.

(10) Patent No.: US 6,695,073 B2
(45) Date of Patent: Feb. 24, 2004

(54) ROCK DRILL BITS, METHODS, AND SYSTEMS WITH TRANSITION-OPTIMIZED TORQUE DISTRIBUTION

(75) Inventors: Kevin L. Glass, Spring, TX (US); Oliver Matthews, III, Spring, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 45 days.

(21) Appl. No.: 10/108,252

(22) Filed: Mar. 26, 2002

(65) Prior Publication Data

US 2002/0157869 A1 Oct. 31, 2002

Related U.S. Application Data

(60) Provisional application No. 60/278,865, filed on Mar. 26, 2001.

(51) Int. Cl.[7] ..... E21B 10/52

(52) U.S. Cl. ..... 175/40; 175/431; 702/9

(58) Field of Search ..... 175/40, 431; 702/9; 73/152.59, 152.49, 152.43

(56) References Cited

U.S. PATENT DOCUMENTS 4,815,342 A * 3/1989 Brett et al. ..... 76/108.2
4,852,399 A * 8/1989 Falconer ..... 73/152.59
5,816,346 A * 10/1998 Beaton ..... 175/431
6,246,974 B1 * 6/2001 Jelley et al. ..... 702/9
6,408,953 B1 * 6/2002 Goldman et al. ..... 175/40
6,460,631 B2 * 10/2002 Dykstra et al. ..... 175/431

* cited by examiner

*Primary Examiner*—David Bagnell
*Assistant Examiner*—Matthew J Smith
(74) *Attorney, Agent, or Firm*—Robert Groover

(57) ABSTRACT

A fixed-cutter drill bit is optimized so that cutter torques are evenly distributed not only during drilling of homogeneous rock, but also in transitional formations.

7 Claims, 8 Drawing Sheets

ROCK DRILL BITS, METHODS, AND SYSTEMS WITH TRANSITION-OPTIMIZED TORQUE DISTRIBUTION

CROSS-REFERENCE TO OTHER APPLICATION

This application claims priority from No. 60/278,865, filed Mar. 26, 2001, which is hereby incorporated by reference.

BACKGROUND AND SUMMARY OF THE INVENTION

The present invention relates to earth-penetrating drill bits, and particularly to fixed-cutter rotating bits such as are used for drilling oil and gas wells.

Background: Rotary Drilling

Oil wells and gas wells are drilled by a process of rotary drilling. In conventional vertical drilling a drill bit is mounted on the end of a drill string (drill pipe plus drill collars), which may be several miles long. At the surface a rotary drive turns the string, including the bit at the bottom of the hole, while drilling fluid (or "mud") is pumped through the string.

When the bit wears out or breaks during drilling, it must be brought up out of the hole. This requires a process called "tripping": a heavy hoist pulls the entire drill string out of the hole, in stages of (for example) about ninety feet at a time. After each stage of lifting, one "stand" of pipe is unscrewed and laid aside for reassembly (while the weight of the drill string is temporarily supported by another mechanism). Since the total weight of the drill string may be hundreds of tons, and the length of the drill string may be tens of thousands of feet, this is not a trivial job. One trip can require tens of hours, and this is a significant expense in the drilling budget. To resume drilling the entire process must be reversed. The bit's durability is very important, to minimize round trips for bit replacement during drilling.

The simplest type of bit is a "drag" bit (or "fixed-cutter" bit), where the entire bit rotates as a single unit. The body of the bit holds fixed teeth, which are typically made of an extremely hard material, such as e.g. tungsten carbide faced with polycrystalline diamond compact (PDC). The body of the bit may be steel, or may be a matrix of a harder material such as tungsten carbide. FIG. 1C shows an exemplary fixed cutter drill bit.

Fixed-cutter bits have undergone a dramatic development in the past decade. Originally PDC-type bits were used for cutting only a limited set of fairly soft formations, but their performance was so good (in appropriate applications) that there has been steady pressure to use them in an increasing range of formations. At the same time the technology of the ultrahard compacts has steadily advanced, as the metallurgy of diamond-loaded cermets has become better understood. The resistance of modern compacts to abrasion is very good, but fracturing is still a limiting factor.

As the drillstring is turned, the teeth of the drag bit are pushed through the rock by the combined forces of the weight-on-bit and the torque seen at the bit. (The torque at the bit will be somewhat less than the rotary or top drive torque, due to drag along the length of the drill string. The torque at the bit may also contain a dynamic component due to oscillation modes of the drill string). Since the weight-on-bit and the rotary torque are controlled by the driller, the net thrust vector seen at the tooth face will be slightly uncertain; but the normal range of torque and WOB values will imply only a relatively small range of angular uncertainty for each tooth's net force vector. (The rate-of-penetration and the hardness of the formation also have some effect on the orientation of the thrust vector seen at the tooth.) Thus each tooth can be aligned to an expected thrust direction, within a cone of a few degrees of uncertainty.

The individual elements of a drill string appear heavy and rigid. However, in the complete drill string (which can be more than a mile long), the individual elements are quite flexible enough to allow oscillation at frequencies near the rotary speed. In fact, many different modes of oscillation are possible. (A simple demonstration of modes of oscillation can be done by twirling a piece of rope or chain: the rope can be twirled in a flat slow circle, or, at faster speeds, so that it appears to cross itself one or more times.) The drill string is actually a much more complex system than a hanging rope, and can oscillate in many different ways; see *WAVE PROPAGATION IN PETROLEUM ENGINEERING*, Wilson C. Chin, (1994).

The oscillations are damped somewhat by the drilling mud, or by friction where the drill pipe rubs against the walls, or by the energy absorbed in fracturing the formation: but often these sources of damping are not enough to prevent oscillation. Since these oscillations occur down in the wellbore, they can be hard to detect, but they are generally undesirable. Drill string oscillations change the instantaneous force on the bit, and that means that the bit will not operate as designed. For example, the bit may drill oversize, or off-center, or may wear out much sooner than expected. Oscillations are hard to predict, since different mechanical forces can combine to produce "coupled modes"; the problems of gyration and whirl are an example of this. These dynamic instabilities can severely degrade drilling performance, and may not be easy to detect from the surface. Moreover, the rock failure process inherently generates stick-slip vibrations to excite dynamic modes.

The other common bit type is the rotary cone (or "roller-cone") bit, in which the bore face is cut by rotating elements (which usually have a roughly conical shape), bearing machined or inserted teeth. FIG. 1B shows an example of such a bit.

Background: Transitional Formations

In interbedded "transitional" formations rock strength can change significantly over a bit length. The present inventors have realized that this is an important factor in the lifetime of fixed-cutter drill bits.

If the overloaded cutter fails, the cutter which follows it will be even more overloaded, and is also likely to fail. Similarly, if any of the frontal area of this cutter is lost to spalling or fracturing, following cutters may be overloaded.

Transition-Optimized Cutter Torque Distribution

The present invention teaches that the forces which appear on the individual cutting elements of a drill bit should be evenly distributed, as far as possible, under transitional conditions as well as under steady-state conditions. Thus when the drill bit drills into a layer of harder or softer rock, the chances of an individual cutter receiving a disproportionate load, and possibly breaking, are greatly reduced. Thus in the preferred embodiment cutter loadings are simulated during a transition into harder rock, and in alternative embodiments cutter loadings can be simulated both during transition to harder rock and during transition to softer rock.

The disclosed innovations, in various embodiments, provide one or more of at least the following advantages:

Improved bit life

Improved cutter life in transitional formations

Lower Repair Cost
Improved ROP
More consistently reliable minimum bit life
Reduced susceptibility to dynamic instabilities.

BRIEF DESCRIPTION OF THE DRAWINGS

The disclosed inventions will be described with reference to the accompanying drawings, which show important sample embodiments of the invention and which are incorporated in the specification hereof by reference, wherein.

DETAILED DESCRIPTION OF THE PREFERRED EMBODIMENTS

The numerous innovative teachings of the present application will be described with particular reference to the presently preferred embodiment (by way of example, and not of limitation).

Figure 2:
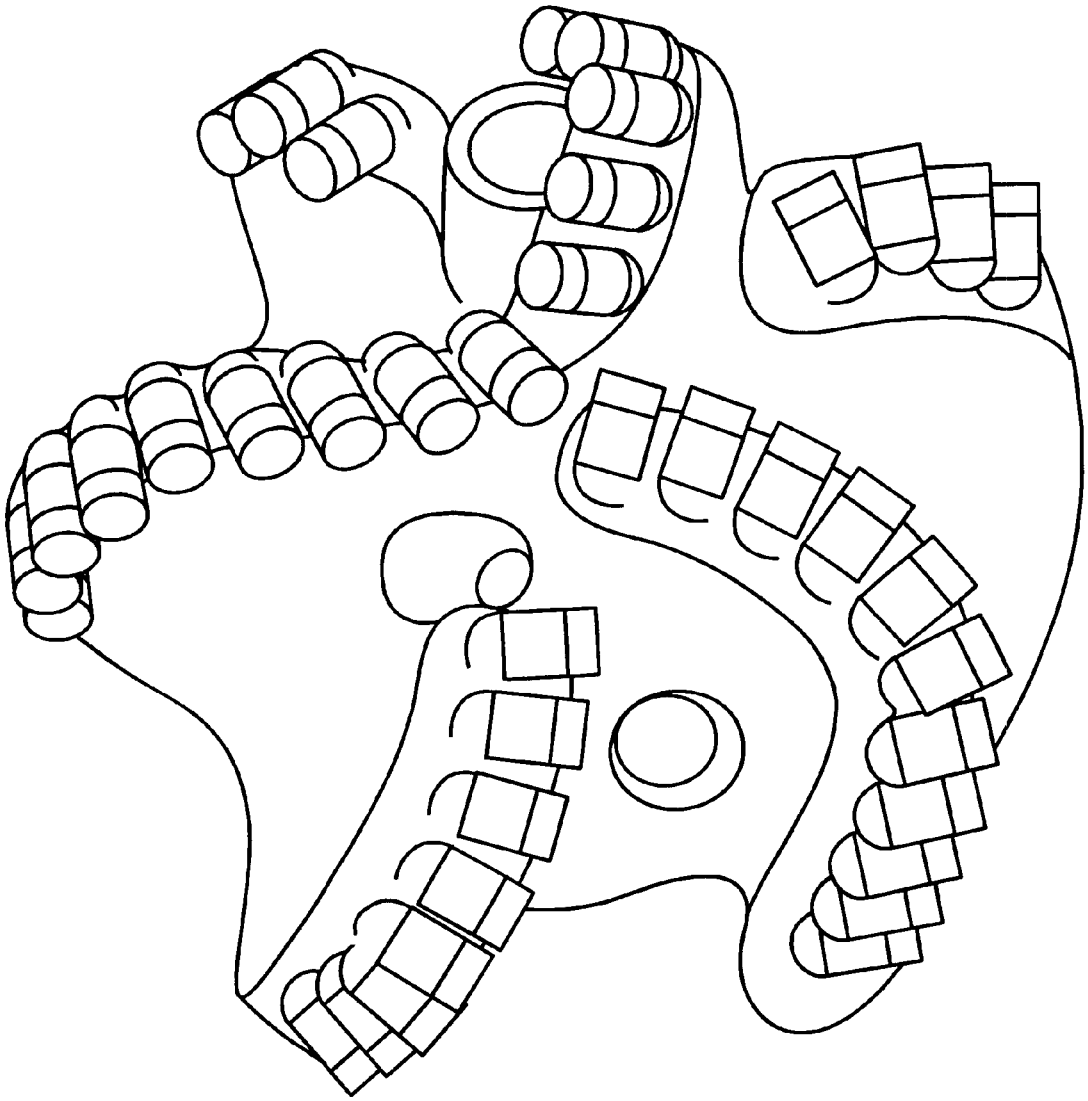
FIG. 2 shows typical impact damage to a PDC bit.

Drilling transition type formations with varying compressive strength rock creates significant challenges for PDC drill bits. The varying rock strength unevenly distributes cutter forces and torque distribution on the nose or face of the bit when part of the bit is in softer formation and the other part is transitioning into harder formation, often resulting in broken PDC cutters. FIG. 2 shows typical impact damage to a PDC bit with deep ring-claw cutters. The example shown is an 8.75" FM2645 design, from a field in South Texas.

The present application describes a method to predict the area or zone most susceptible to impact under specified drilling conditions during the design phase to implement effective solutions to mitigate the effect. The normal method of mitigation is to view the bit after it has been run in the field and evaluate the weakest area for impact after the fact and not during the design phase.

The preferred embodiment capitalizes on the Amoco model to simulate down-hole conditions and calculate cutter forces while simulating drilling through a transition zone of differing compressive strengths. The data is then plotted graphically to visually see the representation of % Torque per Cutter distribution under the specified drilling conditions. The graphical representation will indicate the area susceptible to impact by visually displaying the zone with the highest % Torque per Cutter. The bit design can then be manipulated with such features as bit profile, cutter size, blade position, cutter positioning and cutter redundancy to minimize the effect of the % Torque per Cutter distribution and optimize bit performance for drilling the transition zones. The force resultants of PDC bits are often studied for purposes of directional drilling, but optimization for transitions is normally not considered.

Traditionally, weak areas of impact for PDC bit designs have been identified in the field after a bit has been run. This invention provides a method during the bit design phase to optimize for anticipated impact, which is a common failure for PDC bits while drilling in transition type formations. This method provides a means to predict the zone of highest impact and utilize higher impact resistant PDC cutters where necessary, in addition to utilizing cutter size, bit profile, blade positioning for impact optimization.

Figure 1:
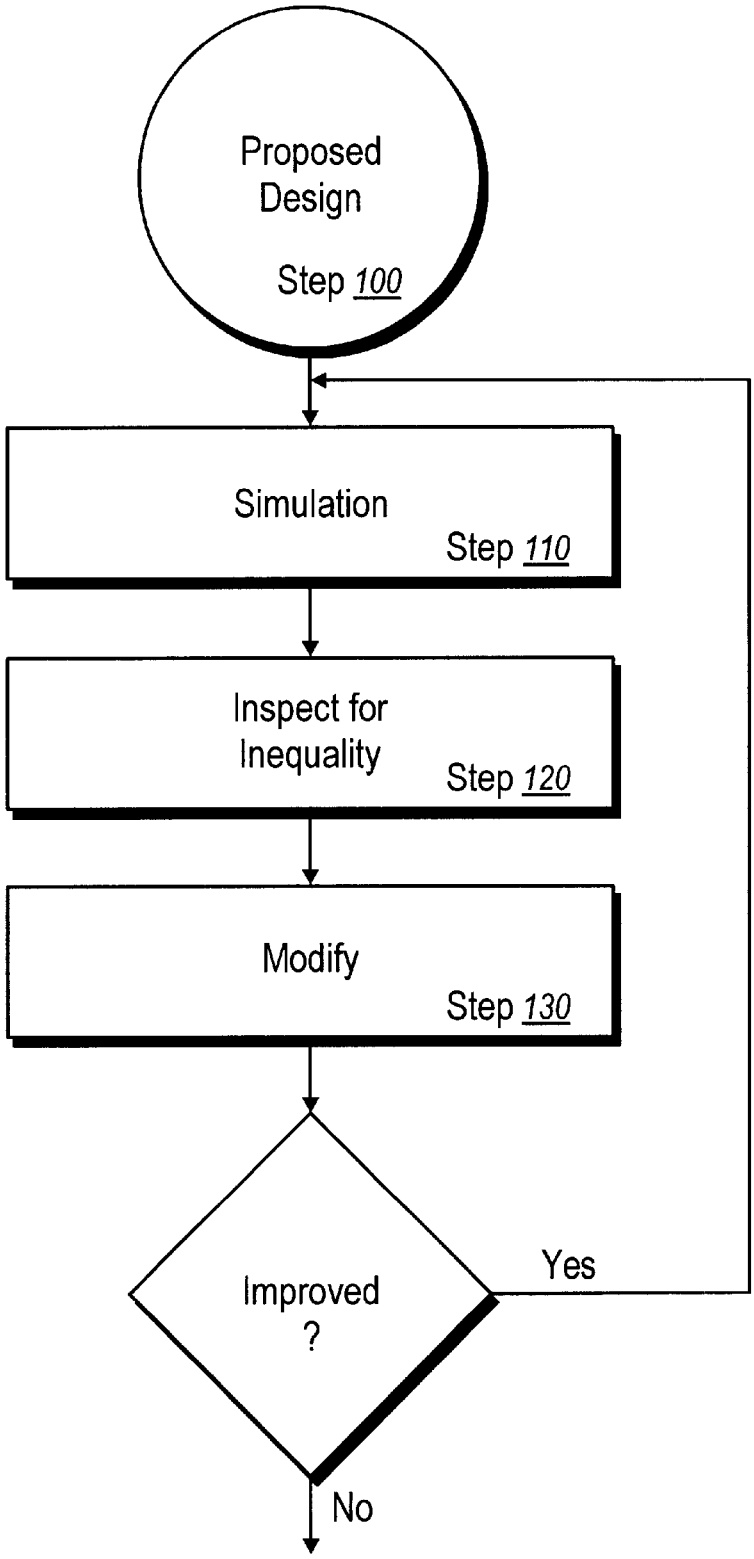
FIG. 1 shows a sample embodiment of the design modification process.

FIG. 1 shows the basic design modification process. A proposed design 100 is simulated (step 110), to derive the cutter loading values as a transition to harder rock is encountered. The cutter loading values through the transition are inspected (step 120), to see whether any one tooth has much higher loadings than others. (For example, in FIG. 3B cutter number 10 has higher loading at the transition.) The design is then modified (step 130) to decrease this peak loading if possible. (The techniques for reducing the peak loading on a particular tooth are well known to bit designers; for example, the tooth in question can be made smaller, given a slightly different angle, or repositioned to protrude just slightly less.)

Program Calculations

The Bed Boundary program is similar to the Amoco drag bit force balance program described in "Drag Bit Performance Modeling", Society of Petroleum Engineers #15618 1986. Cutter force and bit imbalance are also calculated while drilling through a bed boundary (or layered rock) similar to the below described program.

Given the input of bit Rate Of Penetration, Revolutions Per Minute, Rock Strength, cutter type, cutter location, cutter orientation and bed boundary location. The program calculates the reactive force per cutter. These cutter forces are then summed to the orthogonal components of the general force system required to drill at the given input parameters. The orthogonal components are $F_x$ (imbalance), $F_y$ (weight on bit), $F_z$ (imbalance), $M_x$ (imbalance), $M_y$ (torque on bit), $M_z$ (imbalance). These components are summed at the origin of the bit coordinate system. This coordinate system is attached to the bit as defined by the input cutter location data. Cutter forces are defined by a drag force and a penetrating force. The drag force is assumed to be generated at the cutter tip, in the direction of the cutter velocity and is proportional to the cutter engagement area and back-rake angle. A penetrating force is also calculated that is orthogonal to the drag force and is oriented to a vector as defined by the principle moment of inertia of the engagement area. The penetrating force is also proportional to the engagement area and back-rake angle.

In addition to the above calculations, when the bed boundary is encountered by a cutter, the force on that cutter is changed in proportion to the change in rock strength and amount of engagement area in the bed boundary. The force on a cutter will change in proportion to the above parameters until it is fully engaged below the bed boundary.

The above outputs are generated once per revolution of the bit. The output includes cutter force per revolution as a percent of weight on bit or torque on bit, cutter force per revolution and imbalance force per revolution.

Analytical Method

The Transitional Impact Prediction (Trip) Tool is a graphical method to present the percent torque per cutter distribution of a PDC bit design. This method predicts the area most susceptible to impact while drilling interbedded formations with differing compressive strengths. By inputting differential rock compressive strengths into the simulator calculations. The change in cutter forces and torque distribution per cutter can be simulated and plotted. While drilling in a higher compressive strength transition zone, the nose cutters on the bit see the harder formation first and the cutter forces change accordingly. This redistributes the percent torque per cutter until the bit has completely transitioned into the harder rock. The area predicted from this analysis as having the higher percent torque per cutter while this transition is taking place has correlated well with dull bit data from the field showing a very strong correlation.

This analytical tool would allow the bit designer to optimize the bit design for transitional drilling by adjusting cutter size, blade position, bit profile and cutter distribution to minimize the impact effect and optimize the performance of the PDC bit for its intended application.

This graphical method can also be used to show how smooth a transition from one cutter to the next for percent torque per cutter to develop a PDC bit design for directional drilling. Tool face control is a critical element for drilling in a directional application with a PDC bit. Without tool face control, weight on bit can not be applied effectively to achieve competitive rates of penetration. This tool can be utilized to determine if a PDC bit design has a good percent torque per cutter distribution. This will allow the bit designer to adjust bit design parameters such as cutter size, blade position, cutter distribution and bit profile to optimize the performance of the PDC bit for the intended application.

Figure 3A:
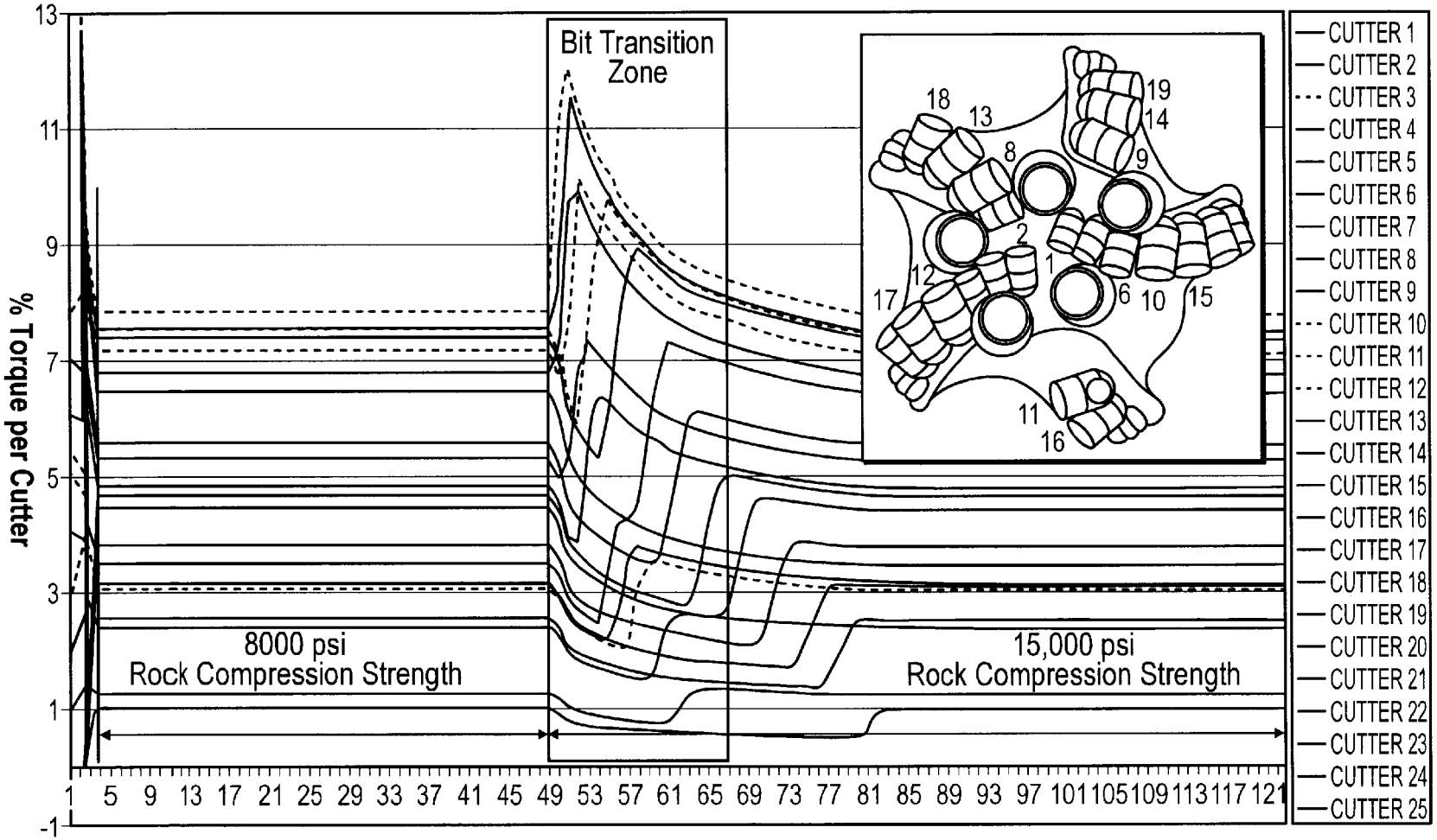
FIGS. 3A and 3B show torque distribution simulations for typical PDC bit designs, and the insets show corresponding cutter damage results.
Figure 3B:
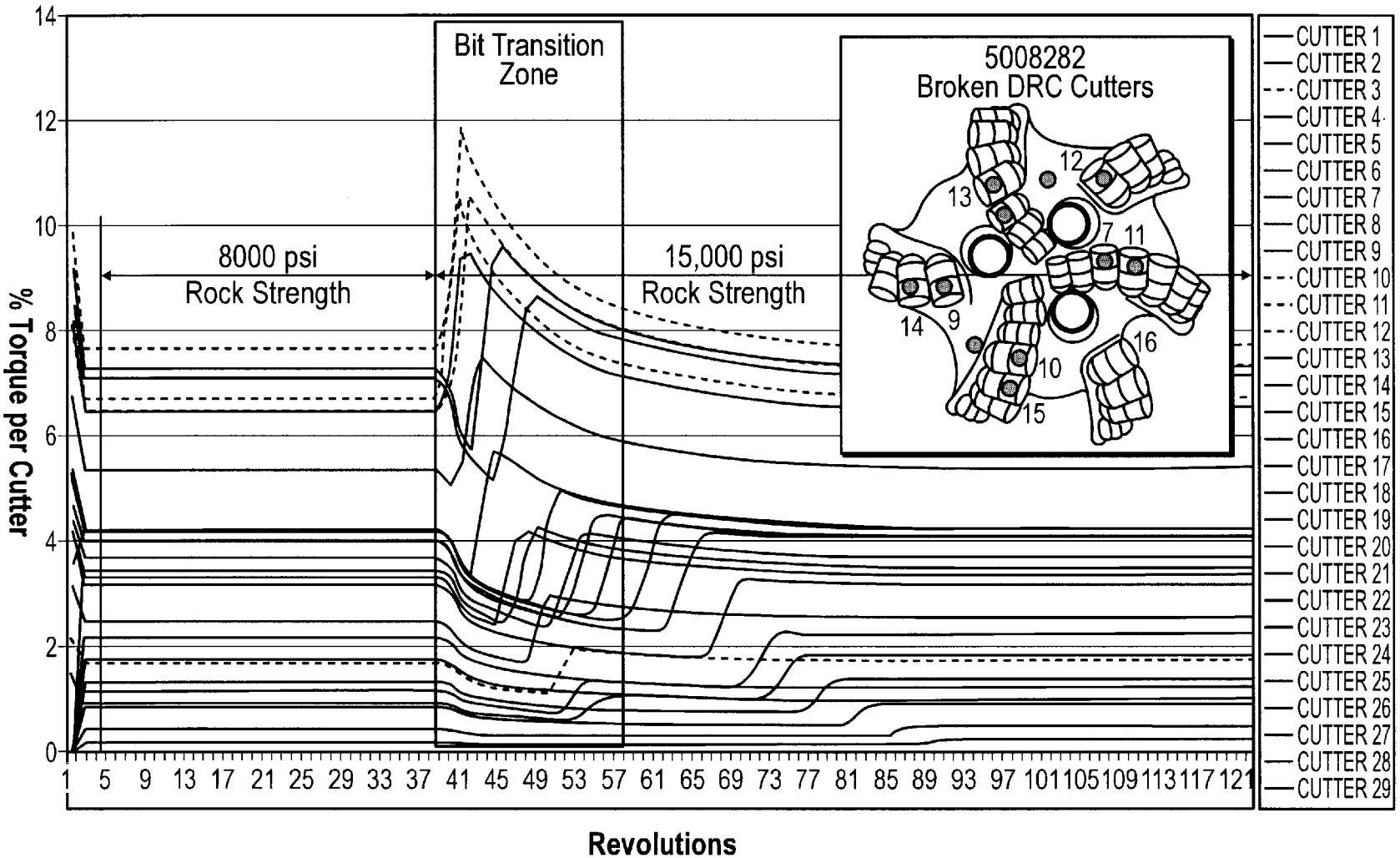

FIGS. 3A and 3B show torque distribution simulations for typical PDC bit designs, and the insets show corresponding cutter damage results. FIG. 3A shows an FM2565 7-⅞" single-set bit, with 13 mm cutters in the center. When the bit hits the harder rock (specified, for this simulation, as 15000 psi compressive strength, versus 8000 psi for the softer rock) after revolution 48, it can be seen that the cutter loads change differently. Note especially that cutters 9 and 10 bear approximately 12% of the total torque load at revolutions 51–52, which is much more than other cutters. (The inset shows the cutter numbers which are referred to.)

FIG. 3B shows an FM2665 7-⅞" single-set bit. When the bit hits the harder rock after revolution 34, cutter 10 briefly bears about 12% of the total torque load (at revolutions 36–37), which is much more than other cutters. The inset shows observed cutter breakage; note that cutter 10 did indeed break, as did other cutters with disproportionate transient loadings (11, 12, 9, and 13).

Figure 4A:
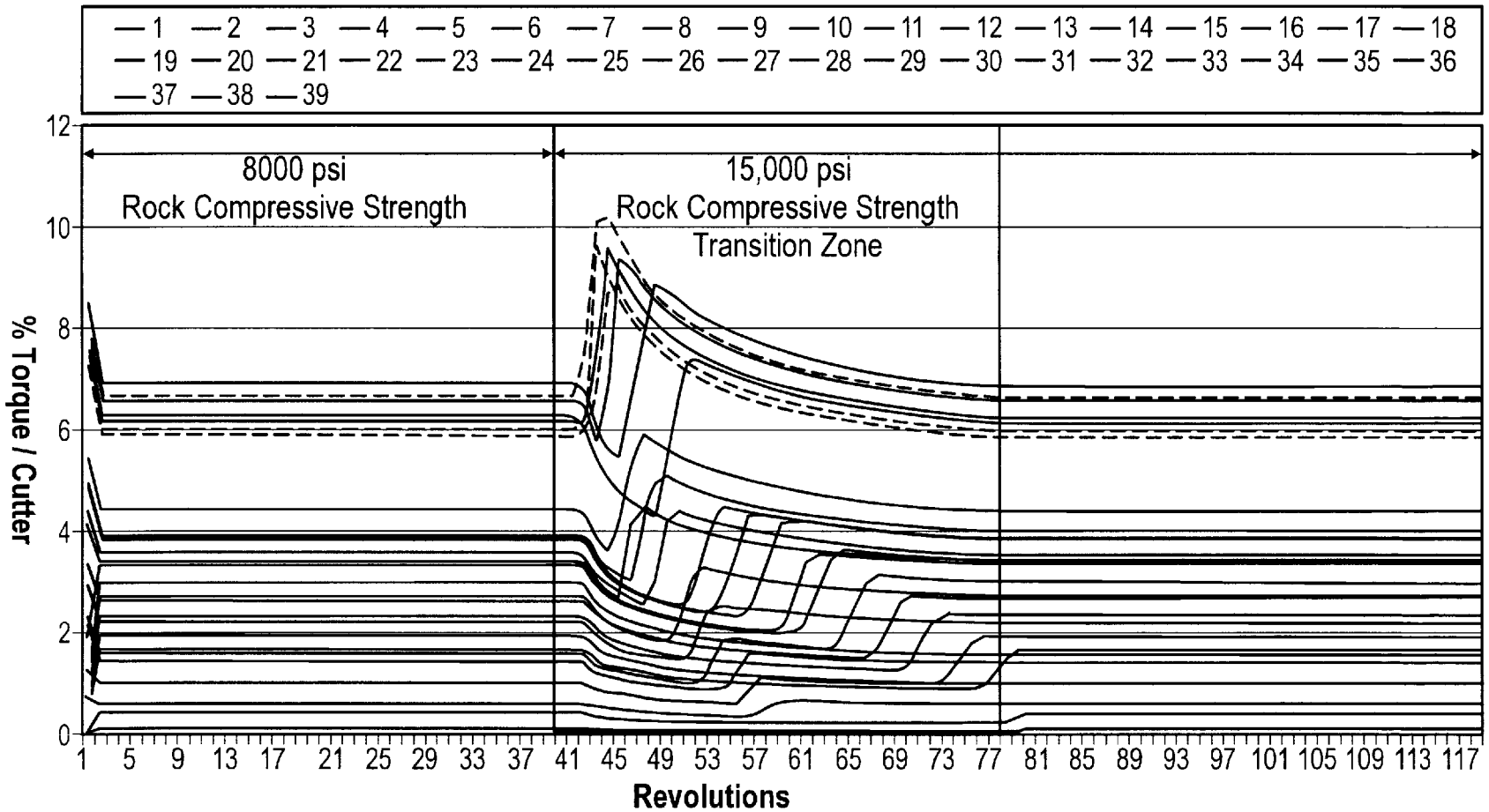
FIGS. 4A, 4B, and 4C show torque distribution simulations for improved PDC bit designs.
Figure 4B:
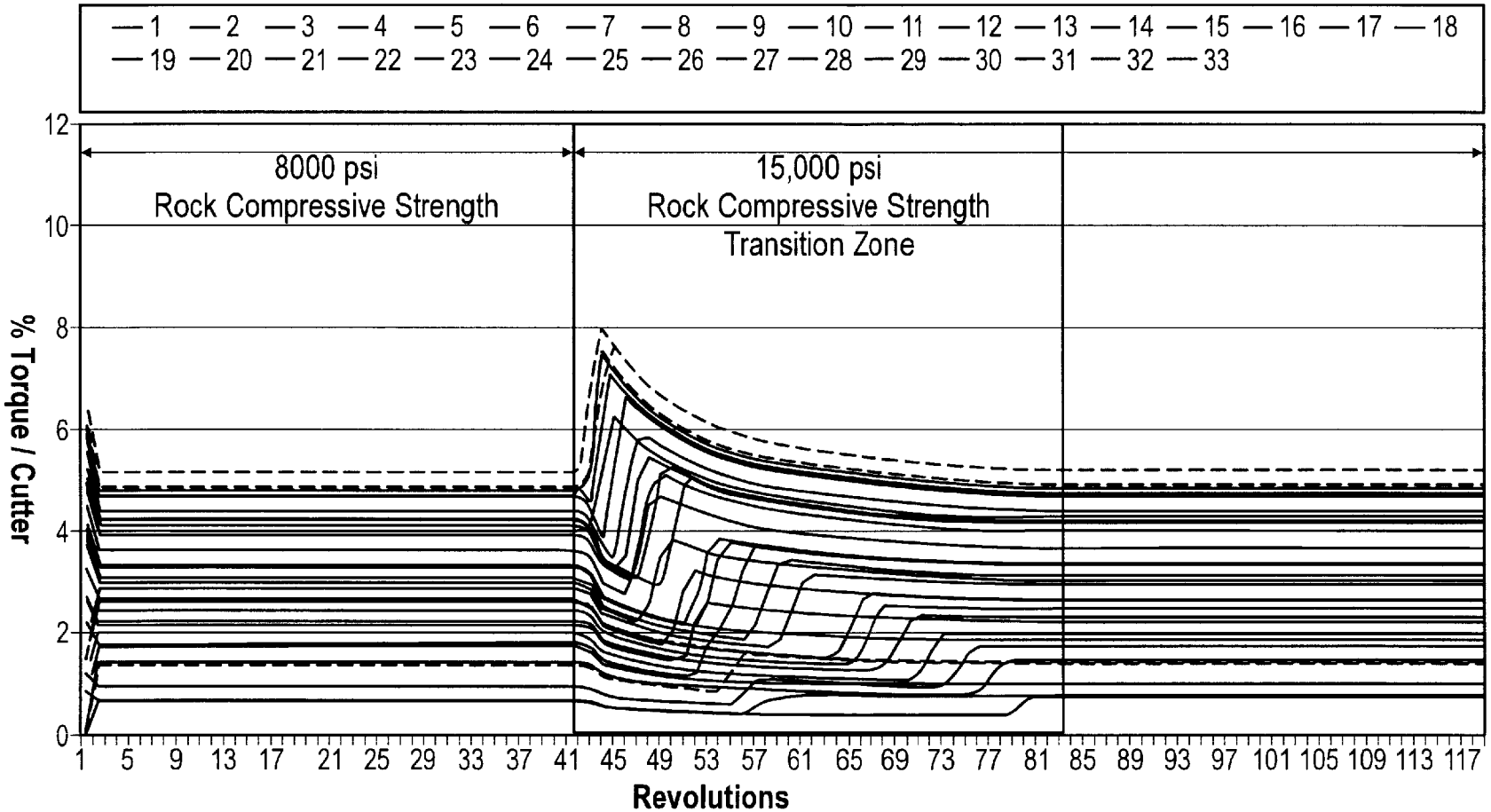
Figure 4C:
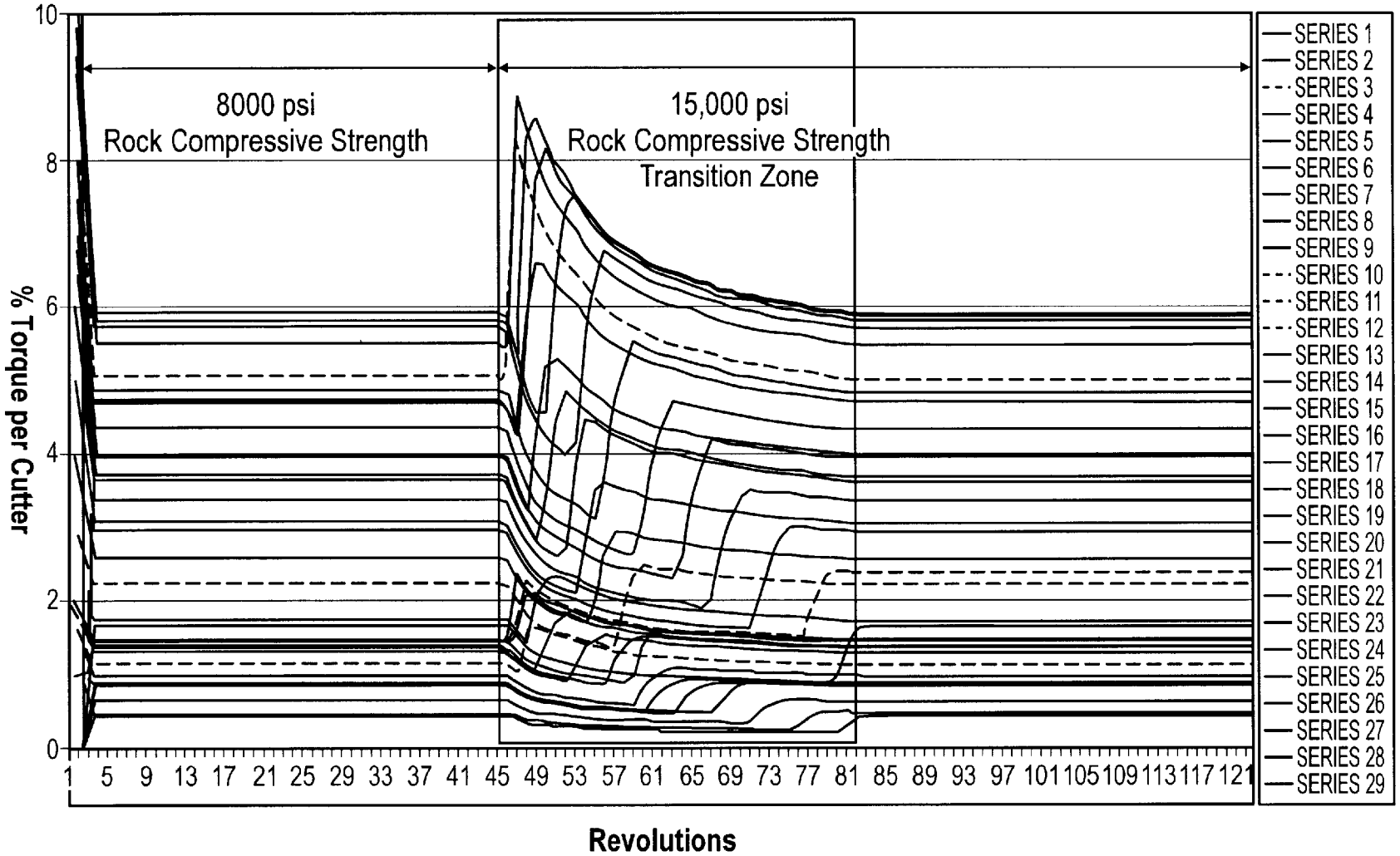

FIGS. 4A, 4B, and 4C show torque distribution simulations for improved PDC bit designs. FIG. 4A shows one example (an 8-¾" FM2665), where the peak cutter torque is slightly over 10%; but notice that the six most heavily loaded cutters all bear fairly similar torque fractions in the transition zone, so it may not have been possible to further equalize peak torques.

FIG. 4B shows another example (an 8-¾" FM2653), where the peak cutter torque is only 8%. Here too it should be noted that the six most heavily loaded cutters all bear fairly similar torque fractions in the transition zone.

FIG. 4C shows another example (an 8-¾" FM2645), where the peak cutter torque is about 9%. Again, note that the most heavily loaded cutters all bear fairly similar torque fractions in the transition zone.

All of these figures should be contrasted to FIGS. 3A and 3B, where individual cutters briefly jump to very high torque values when the transition zone is encountered. The degree to which any individual cutter's peak loading can be reduced is dependent on other design factors, but the present application does teach that reducing peak cutter loadings in the transition zone, by balancing cutter loads, is advantageous.

Sample Complete Drilling System

Figure 1A:
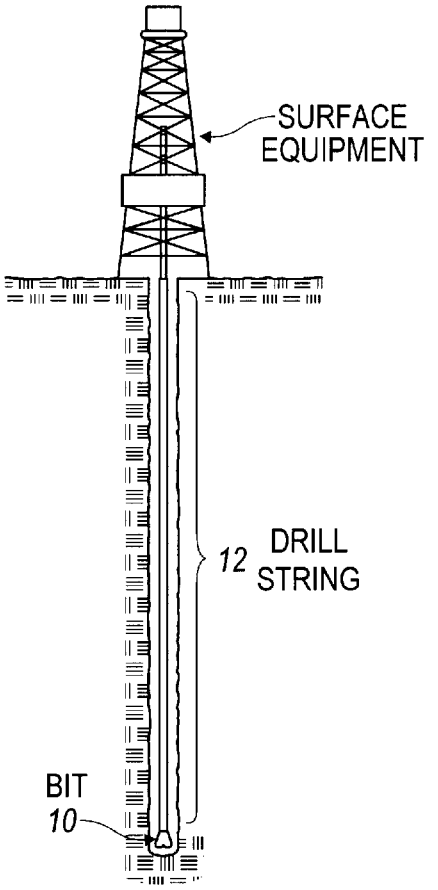
FIG. 1A (PRIOR ART)
FIG. 1A shows an exemplary drill rig.
Figure 1B:
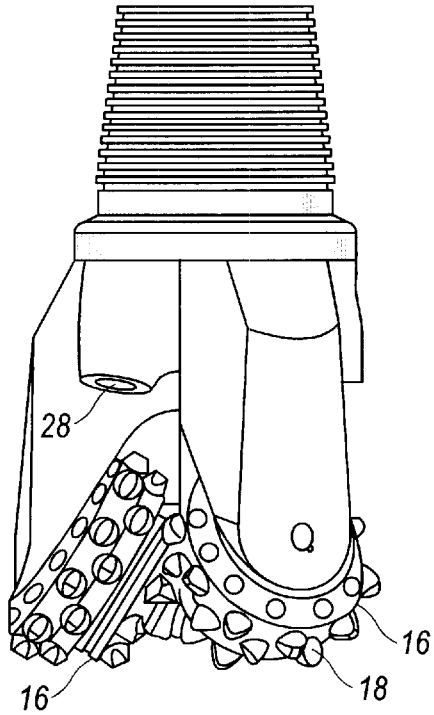
FIG. 1B (PRIOR ART)
FIG. 1B shows an exemplary rotary cone drill bit.
Figure 1C:
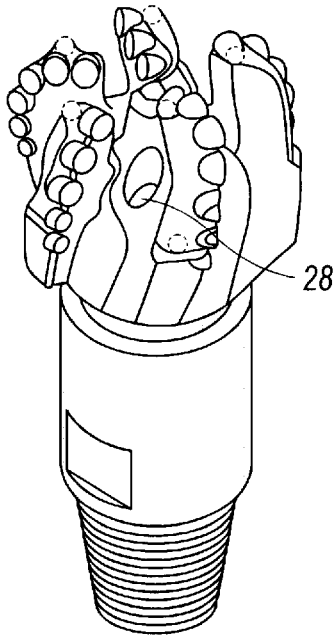
FIG. 1C (PRIOR ART)
FIG. 1C shows an exemplary fixed cutter drill bit.

FIG. 1A generally shows a drill rig performing rotary drilling. In conventional vertical drilling, a drill bit 10 is mounted on the end of a drill string 12 (drill pipe plus drill collars), which may be several miles long, while at the surface a rotary drive (not shown) turns the drill string, including the bit at the bottom of the hole. A mud pump forces drilling fluid, at high pressures and flow rates, through the drill string.

According to a disclosed class of innovative embodiments, there is provided: A fixed-cutter drill bit, having cutting components sized, positioned, and/or oriented to provide even torque distribution both when the bit is penetrating approximately homogeneous rock and also when the bit is penetrating across a transition into harder rock.

According to another disclosed class of innovative embodiments, there is provided: A drill bit comprising: a body, and a plurality of cutting devices positioned to remove rock, and thereby advance a borehole, as torque and downforce are applied to said body; wherein said cutting devices are sized, positioned and oriented to provide even torque distribution on said body BOTH when said borehole is penetrating homogeneous rock having a first failure strength AND ALSO when said borehole encounters a transition into rock having a second failure strength which is different from said first failure strength.

According to another disclosed class of innovative embodiments, there is provided: A rotary drilling system, comprising: a bit having cutters which bear approximately equalized loads both under homogeneous drilling conditions and also under transitional drilling conditions; a drill string which is connected to conduct drilling fluid to said bit from a surface location; and a rotary drive which rotates at least part of said drill string together with said bit.

According to another disclosed class of innovative embodiments, there is provided: A method for designing an earth-penetrating drill bit, comprising the actions of: computing first torque components, for various respective portions of the bit, when the bit is penetrating approximately homogeneous rock; computing second torque components, for said respective portions of the bit, when the bit is penetrating across a transition into harder rock; and adjusting the size and/or placement and/or orientation of said portions of the bit, to balance both said first torque components and also said second torque components around an axis of rotation of said bit.

Modifications and Variations

As will be recognized by those skilled in the art, the innovative concepts described in the present application can be modified and varied over a tremendous range of applications, and accordingly the scope of patented subject matter is not limited by any of the specific exemplary teachings given.

In various embodiments, various ones of the disclosed inventions can be applied not only to bits for drilling oil and gas wells, but can also be adapted to other rotary drilling applications (especially deep drilling applications, such as geothermal, geomethane, or geophysical research).

In various embodiments, various ones of the disclosed inventions can be applied not only to top-driven and table-driven configurations, but can also be applied to other rotary drilling configurations, such as motor drive.

In various embodiments, various ones of the disclosed inventions can be applied not only to drill bits per se, but also to related rock-penetrating tools, such as reamers, coring tools, etc.

The disclosed inventions are not applicable only to top-driven and table-driven configurations, but can also be applied to other rotary drilling configurations, such as motor drive.

Note that the disclosed inventions are not applicable only to bits for drilling oil and gas wells, but can also be adapted to other rotary drilling applications (especially deep drilling applications, such as geothermal, geomethane, or geophysical sampling bores).

In the presently preferred embodiment the transition is modelled as a direct sharp junction, with no gradation separating the harder rock from the softer rock, but in alternate embodiments the transition can be modelled as a gradation over inches or tens of inches.

In various embodiments, various disclosed inventions can be applied to roller-cone as well as fixed-cutter bits. More generally, the disclosed inventions can be adapted to ANY rock bit or penetrating tool, especially to any fixed-cutter bit, and most especially to any bit which has cutting action (as opposed to crushing).

In the preferred embodiment described above, balance of the nose cutters when entering a harder horizon is particularly emphasized. However, cutter balance when entering softer formations is also contemplated as advantageous. Here the improved cutter balance can be particularly advantageous in avoiding initiation of dynamic instabilities.

In the preferred embodiment described above, torque distribution of the nose cutters when entering a harder horizon or shoulder cutters when entering a softer formation is particularly emphasized. Here the improved cutter torque distribution can be particularly advantageous in avoiding initiation of dynamic instabilities.

In another class of alternative embodiments, torque distribution can also be checked under conditions of angled horizons (i.e. when the plane of the transition is not normal to the bore being drilled). Here too a check on force balancing under these conditions can be used to optimize and/or check a bit design, to minimize the likelihood of cutter breakage when such a transition is encountered in the field.

Note also that, while the disclosed inventions are particularly advantageous in drilling formations which are known to be transitional, they can also be useful in optimizing bits for any formation.

Note also that the specific rock failure strengths used in the illustrated embodiment are merely exemplary, and other strengths can be used.

It is also not particularly necessary to use an Amoco-type torque model, and other force modelling tools can be used. Note also that many modifications in the simulation can be made, as will be readily recognized by those skilled in the art, to take account of contributions due to cuttings flow, wear pads, incipient instability, etc.

Additional general background, which helps to show the knowledge of those skilled in the art regarding implementation options and the predictability of variations, may be found in the following publications, all of which are hereby incorporated by reference: Baker, A PRIMER OF OILWELL DRILLING (5.ed. 1996); Bourgoyne et al., APPLIED DRILLING ENGINEERING (1991); Davenport, HANDBOOK OF DRILLING PRACTICES (1984); DRILLING (Australian Drilling Industry Training Committee 1997); FUNDAMENTALS OF ROTARY DRILLING (ed. W. W. Moore 1981); Harris, DEEPWATER FLOATING DRILLING OPERATIONS (1972); Maurer, ADVANCED DRILLING TECHNIQUES (1980); Nguyen, OIL AND GAS FIELD DEVELOPMENT TECHNIQUES: DRILLING (1996 translation of 1993 French original); Rabia, OILWELL DRILLING ENGINEERING/PRINCIPLES AND PRACTICE (1985); Short, INTRODUCTION TO DIRECTIONAL AND HORIZONTAL DRILLING (1993); Short, PREVENTION, FISHING & REPAIR (1995); UNDERBALANCED DRILLING MANUAL (Gas Research Institute 1997); the entire PetEx Rotary Drilling Series edited by Charles Kirkley, especially the volumes entitled MAKING HOLE (1983) and THE BIT (Kate Van Dyke, 4.ed. 1995); the SPE reprint volumes entitled "Drilling," "Horizontal Drilling," and "Coiled-Tubing Technology"; and the Proceedings of the annual IADC/SPE Drilling Conferences from 1990 to date; all of which are hereby incorporated by reference.

None of the description in the present application should be read as implying that any particular element, step, or function is an essential element which must be included in the claim scope: THE SCOPE OF PATENTED SUBJECT MATTER IS DEFINED ONLY BY THE ALLOWED CLAIMS. Moreover, none of these claims are intended to invoke paragraph six of 35 USC section 112 unless the exact words "means for" are followed by a participle.

What is claimed is:

1. A method for designing an earth-penetrating drill bit, comprising the actions of:

computing first torque components, for various respective portions of the bit, when the bit is penetrating approximately homogeneous rock;

computing second torque components, for said respective portions of the bit, when the bit is penetrating across a transition into harder rock; and adjusting the size and/or placement and/or orientation of said portions of the bit, to balance both said first torque components and also said second torque components around an axis of rotation of said bit.

2. The method of claim 1, wherein said bit is a fixed-cutter bit.

3. The method of claim 1, further comprising the step of: computing third torque components, for said respective portions of the bit, when the bit is penetrating across a transition into softer rock; and wherein said adjusting step balances not only said first and second torque components, but also said third components.

4. An earth-penetrating drill bit designed by the method of claim 1.

5. A fixed-cutter bit designed by the method of claim 2.

6. An earth-penetrating drill bit designed by the method of claim 3.

7. A fixed-cutter bit designed by the method of claim 3.

* * * * *